US006718145B2

(12) United States Patent
Ohta et al.

(10) Patent No.: US 6,718,145 B2
(45) Date of Patent: Apr. 6, 2004

(54) IMAGE FORMING APPARATUS CAPABLE OF DETERMINING TYPE OF RECORDING SHEET TO PREVENT SHEET JAM

(75) Inventors: So Ohta, Tokyo (JP); Masataka Shimoohsako, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/139,508

(22) Filed: May 7, 2002

(65) Prior Publication Data

US 2002/0186979 A1 Dec. 12, 2002

(30) Foreign Application Priority Data

May 7, 2001 (JP) ..... 2001-136368
Apr. 16, 2002 (JP) ..... 2002-113429

(51) Int. Cl.[7] ..... G03G 15/00
(52) U.S. Cl. ..... 399/16; 399/45; 399/389
(58) Field of Search ..... 399/45, 16, 18, 399/389

(56) References Cited

U.S. PATENT DOCUMENTS 5,287,158 A 2/1994 Nagashima et al.
5,689,757 A * 11/1997 Ferrante et al. ..... 399/45
5,831,744 A 11/1998 Kataoka

FOREIGN PATENT DOCUMENTS

| | | |
|---|---|---|
| JP | 58-36832 | 3/1983 |
| JP | 58-97062 | 6/1983 |
| JP | 8-137341 | 5/1996 |
| JP | 2000-037915 | 2/2000 |
| JP | 2000-098813 | 4/2000 |
| JP | 2000-098814 | 4/2000 |
| JP | 2000-247465 | 9/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus includes a recording sheet type detection device to automatically detect a type of a recording sheet. A setting device sets an image forming condition by an operator. The image forming condition includes the type of the recording sheet. An image forming device forms a visible image on the recording sheet. A sheet feeding device feeds the recording sheet to the image forming device. A controller controls the image forming apparatus not to form an image on the recording sheet when the image forming condition with regard to the type of the recording sheet set by the operator does not match the type of the recording sheet detected by the recording sheet type detection device.

31 Claims, 10 Drawing Sheets

IMAGE FORMING APPARATUS CAPABLE OF DETERMINING TYPE OF RECORDING SHEET TO PREVENT SHEET JAM

BACKGROUND OF THE INVENTION

1. Field of the Invention

The present invention relates to an image forming apparatus, such as a copier, a facsimile, a printer and other similar devices in which an image is formed on a sheet-like recording medium, and more particularly to the image forming apparatus that can control a printing condition according to a type of the sheet-like recording medium.

2. Discussion of the Background

As color ink jet printer technology develops, the color ink jet printer is often installed together with a color copier in an office. However, an image forming process of the copier is different from that of the ink jet printer. Thus, if a printing operation is performed by the copier using a recording sheet intended for the ink jet printer, a problem such as a jam of the recording sheet in a fixing device arises. A surface of the recording sheet for the ink jet printer is processed such that ink is appropriately applied to the recording sheet and does not blot. Therefore, if the recording sheet is heated and pressed by a fixing device of the copier, the recording sheet adheres to a surface of a fixing roller, resulting in the jam of the recording sheet in the fixing device.

Several proposals have been made to address the above-described problem, for example, in Japanese Patent Laid-Open Publication Nos. 2000-98814, 2000-98813, and 2000-37915. In Japanese Patent Laid-Open Publication No. 2000-98814, a technology for determining whether a recording sheet is a normal recording sheet or an overhead transparency film sheet using a plurality of sensors and controlling conditions such as a sheet conveying speed is discussed. In Japanese Patent Laid-Open Publication No. 2000-98813, a mark is provided to a genuine brand overhead transparency film sheet. A plurality of sensors sense the mark to determine that the sheet is the genuine brand overhead transparency film. In addition, the sensors determine a side of the sheet (i.e., a front or rear surface of the sheet). In Japanese Patent Laid-Open Publication No. 2000-37971, a type of a recording sheet is determined to adjust a speed of a printing process.

In the above-described background art, a main objective of the technology is directed to improve quality of an image, but is not directed to address the above-described problem. Conventionally, a note mentioning that a recording sheet for a ink jet printer cannot be used and the genuine brand overhead transparency film sheet should be used is used to draw an operator's attention, while leaving a final decision to the operator.

However, problems arise due to an erroneous setting of printing conditions by the operator and/or an use of an undesignated recording sheet. The problems include a jam of the recording sheet, resulting in a replacement of a component of the apparatus with a new component.

SUMMARY OF THE INVENTION

The present invention has been made in view of the above-mentioned and other problems, and addresses the above-discussed and other problems.

The present invention advantageously provides a novel image forming apparatus that can automatically determine a type of a recording sheet in use to prevent problems such as a jam of the recording sheet.

According to an example of the present invention, an image forming apparatus includes a recording sheet type detection device to automatically detect a type of a recording sheet. A setting device sets an image forming condition by an operator, the image forming condition including the type of the recording sheet. An image forming device forms a visible image on the recording sheet. A sheet feeding device feeds the recording sheet to the image forming device. A controller controls the image forming apparatus not to form an image on the recording sheet when the image forming condition with regard to the type of the recording sheet set by the operator does not match the type of the recording sheet detected by the recording sheet type detection device.

According to another example of the present invention, an image forming apparatus includes a recording sheet type detection device to automatically detect a type of a recording sheet, and a setting device to set an image forming condition by an operator, the image forming condition including the type of the recording sheet. An image forming device forms a visible image on the recording sheet. A sheet feeding device feeds the recording sheet to the image forming device. A controller controls the image forming apparatus to stop an image forming operation after the image forming operation is started according to an instruction provided by the operator, when the image forming condition with regard to the type of the recording sheet set by the operator does not match the type of the recording sheet detected by the recording sheet type detection device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
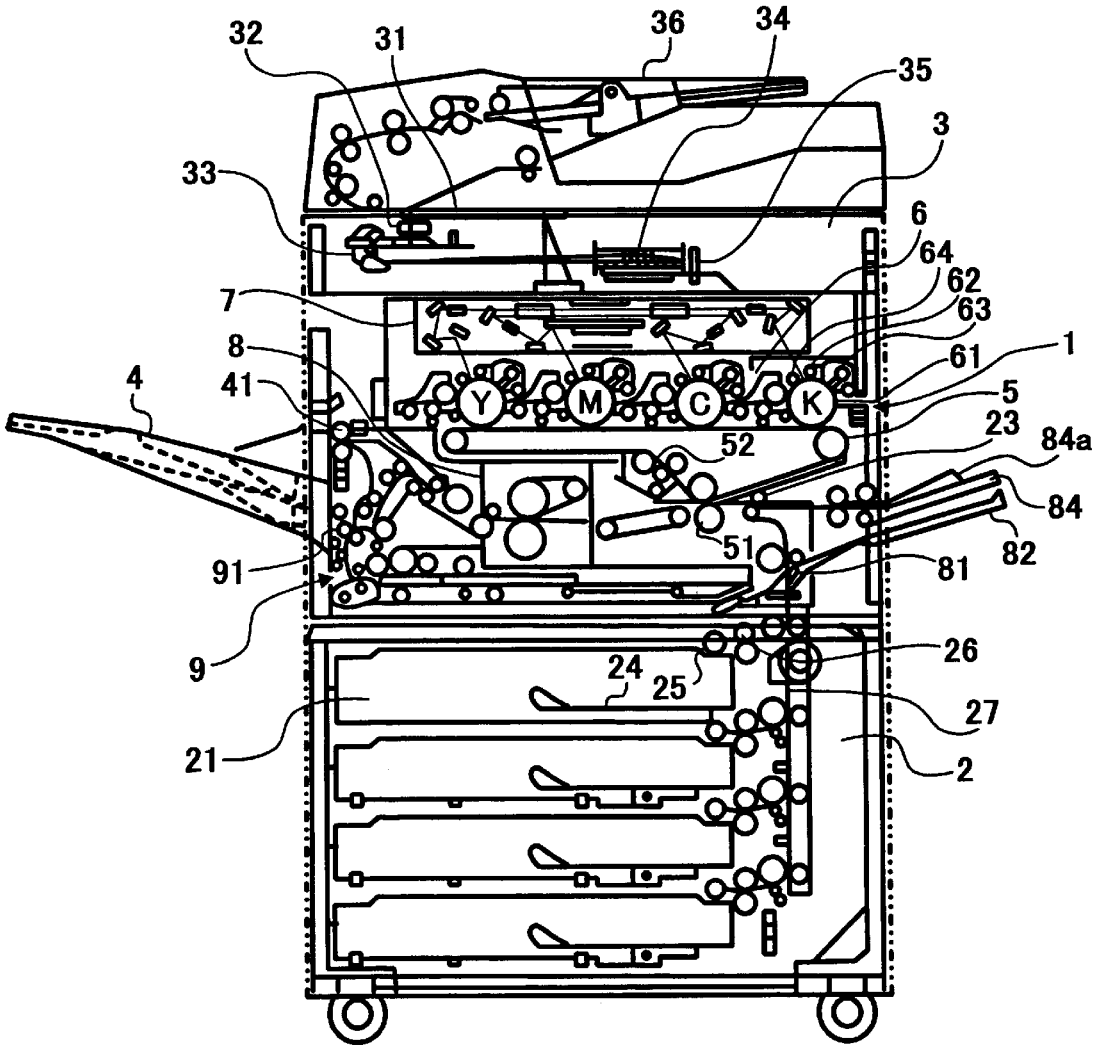
FIG. 1 is a schematic drawing illustrating a construction of a tandem color image forming apparatus according to an example of the present invention.

Referring now to the drawings, wherein like reference numerals designate identical or corresponding parts throughout the several views, FIG. 1 is a schematic drawing illustrating a construction of a tandem color image forming apparatus according to an example of the present invention.

The image forming apparatus includes an image forming section 1 approximately in a center of the apparatus, and a sheet feeding section 2 immediately below the image forming section 1. Sheet feeding trays 21 are vertically arranged in the sheet feeding section 2. An image reading section 3 that reads an original document is provided above the image forming section 1. A sheet discharging tray 4 is arranged at an downstream side of the image forming section 1 in a recording sheet conveying direction (i.e., in the direction of left in FIG. 1). A discharged recording sheet 20 having an image thereon is stacked on the sheet discharging tray 4.

In the image forming section 1, a plurality of image forming units 6 for yellow (Y), magenta (M), cyan C, and black (K)colors are disposed in series above an endless intermediate transfer belt 5. In each image forming unit 6, a charging device 62, an exposing section, a developing device 63, and a cleaning device 64 are disposed around a drum-shape photoconductive element 61. The charging device 62 charges a surface of the photoconductive element 61. In the exposure section, an exposure device irradiates the surface of the photoconductive element 61 with a laser beam according to image information. The developing device 63 develops an electrostatic latent image formed on the surface of the photoconductive element 61 into a visible image with toner. The cleaning device 64 removes residual toner remaining on the surface of the photoconductive element 61 after the toner image has been transferred on the intermediate transfer belt 5.

As an image forming process, each color toner image is transferred on the intermediate transfer belt 5 one after another so that each successive color toner image is superimposed onto the others, thereby forming a color image. First, a yellow image is developed into a yellow toner image in a yellow image forming unit and the yellow toner image is transferred on the intermediate transfer belt 5. A magenta image is then developed into a magenta toner image in a magenta image forming unit and the magenta toner image is transferred on the intermediate transfer belt 5. Then, a cyan image is developed into a cyan toner image in a cyan image forming unit and the cyan toner image is transferred on the intermediate transfer belt 5. Finally, a black image is developed into a black toner image in a black image forming unit and the black toner image is transferred on the intermediate transfer belt 5. The four colors toner image transferred on the intermediate transfer belt 5 is transferred onto the recording sheet 20, which is fed by the sheet feeding section 2, by a transfer device 51. The toner image is fixed onto the recording sheet 20 by a fixing device 8. The recording sheet 20 having the fixed image thereon is either discharged to the sheet discharging tray 4 by a sheet discharging roller 41 or conveyed to a duplex unit 9. When an image is formed on both surfaces of the recording sheet 20, a recording sheet conveying path is branched off from a branch point 91 such that the recording sheet 20 is conveyed to the duplex unit 9 where the recording sheet 20 is reversed. A registration roller 23 corrects skew of the recording sheet 20. An image is then formed on an back surface of the recording sheet 20 in a manner identical to that in which an image is formed on a front surface of the recording sheet 20. A cleaning device 52 removes residual toner remaining on a surface of the intermediate transfer belt 5 after the color toner image has been transferred onto the recording sheet 20.

Figure 3:
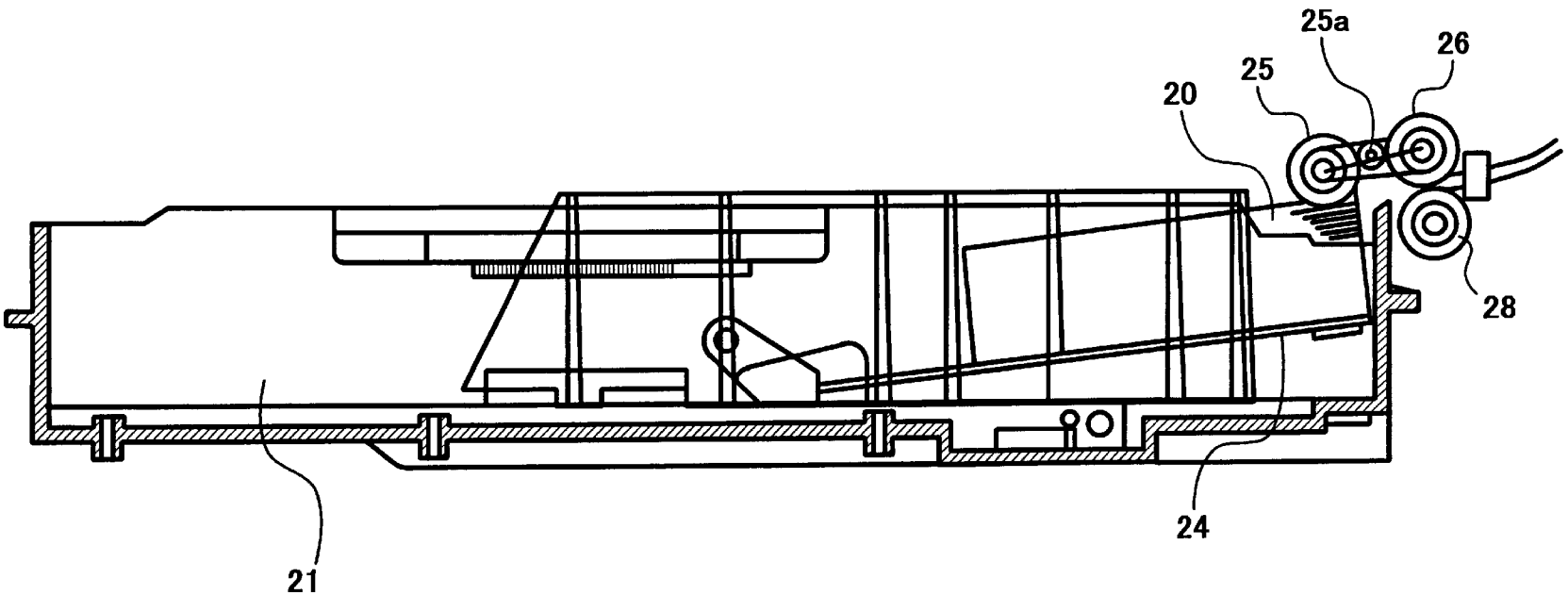
FIG. 3 is a drawing illustrating an enlarged view of a sheet feeding section.

As illustrated in FIG. 3, the sheet feeding tray 21 accommodates an unused recording sheet 20. One end of a baseplate 24, the other end of which is pivoted to a bottom portion of the sheet feeding tray 21, is lifted to a position where an upper-most recording sheet 20 abuts against a pickup roller 25. The pickup roller 25 rotates as a sheet feeding roller 26 rotates to feed the upper-most recording sheet 20 from the sheet feeding tray 21. The sheet feeding roller 26 conveys the recording sheet 20 to the registration roller 23 via a vertical sheet conveying path 27. The registration roller 23 temporarily stops the conveyance of the recording sheet 20. The registration roller 23 then feeds the recording sheet 20 by adjusting the feeding timing such that the recording sheet 20 is in precise register with a toner image on the intermediate transfer belt 5. The registration roller 23 also functions as described above in a case where the recording sheet 20 is fed from a manual sheet feeding tray 84.

In the image reading section 3, a first and second carriages 32 and 33, which carry a light source to shine an original document and mirror, moves back and forth to scan the original document (not shown) placed on a platen 31. A lens 35 condenses image information acquired by scanning the original document onto an imaging surface of a CCD 35 disposed behind the lens 35. The CCD 35 read the image information as an image signal. The read image signal is processed into a digitized form. A laser diode (not shown) in the exposing device 7 emits light based on the processed image signal to optically write an image on a surface of the photoconductive element 61, thereby forming an electrostatic latent image thereon. The light emitted from the laser diode is guided to the surface of the photoconductive element 61 via a known polygon mirror and lens. Automatic document feeder 36 that automatically conveys an original document to the platen 31 is provided above the image reading section 3.

The image forming apparatus according to the example of the present invention is a multifunctional image forming apparatus that includes a facsimile function, and a printer function in addition to the above-described digital color copier function. The facsimile function includes a control device (not shown) that transmits image information of an original document to another site or receives the image information of the original document from another site. The printer function includes a printing function of printing image information processed by a computer on a recording sheet. An image formed by any of above functions is formed on the recording sheet 20 through a similar process. The recording sheet 20 is then discharged to the sheet discharging tray 4.

Figure 2A:
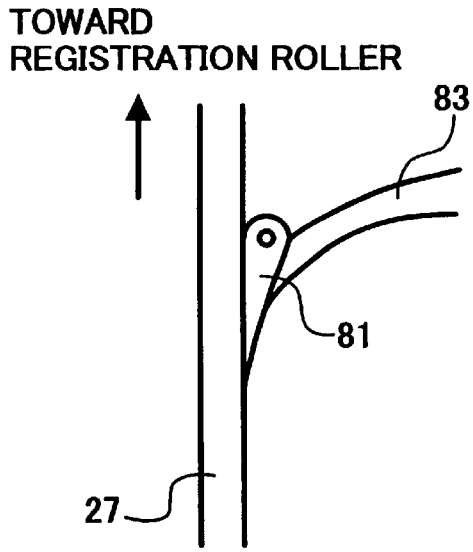
FIGS. 2A and 2B are drawings illustrating enlarged views of a separation pick 81 disposed in a vertical sheet conveying path.
Figure 2B:
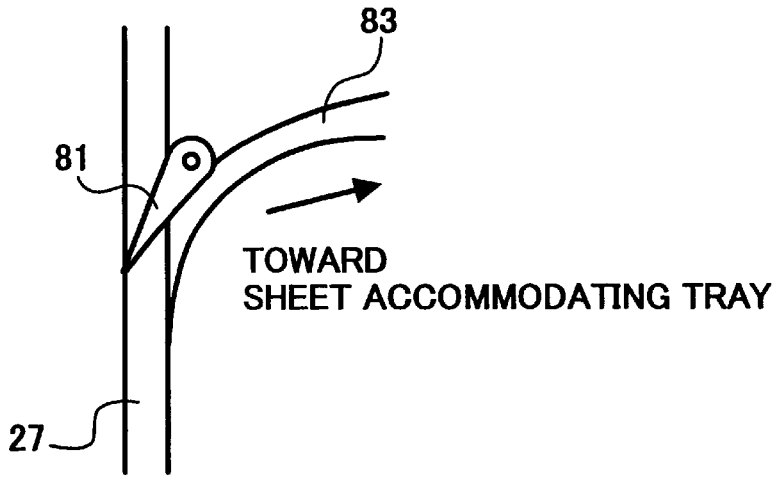

FIGS. 2A and 2B are drawings illustrating enlarged views of a separation pick 81 disposed in the vertical sheet conveying path 27. As shown in FIGS. 2A and 2B, the separation pick 81 is arranged at an upstream side of the registration roller 23 in the recording sheet 20 conveying direction. A sheet discharging path 83 that conveys the recording sheet 20 from the separation pick 81 to a sheet accommodating tray 82 is provided. Thus, a forcible sheet discharging section includes the separation pick 81, sheet discharging path 83, and sheet accommodating tray 82. As described below, if a type of a recording sheet 20 set by an operator does not match information on the type of the recording sheet 20 that is detected by a detecting device, an image forming operation is stopped. The recording sheet 20 in the vertical sheet conveying path 27 is then discharged to the sheet accommodating tray 82 without being conveyed through the image forming section 1 and fixing device 8. Generally, the vertical sheet conveying path 27 is opened and the sheet discharging path 83 is closed as illustrated in FIG. 2A.

Figure 4:
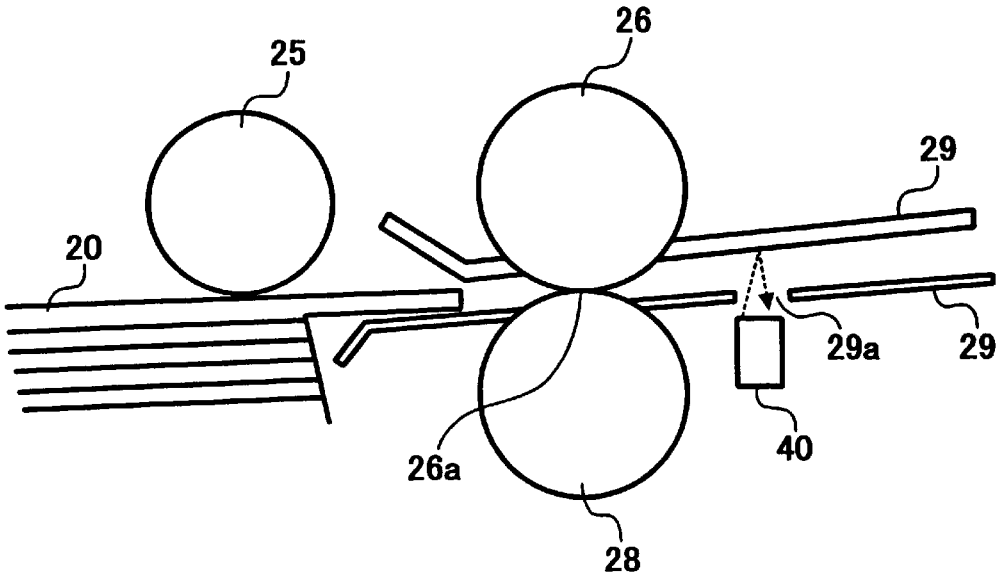
FIG. 4 is a drawing illustrating a main portion of a FRR (Feed Reverse Roller) type sheet feeding section.

FIG. 3 is a drawing illustrating an enlarged view of the sheet feeding section 2. The sheet feeding section 2 includes the sheet feeding tray 21, pickup roller 25, sheet feeding roller 26, and a reversing roller 28. The pickup roller 25 feeds an upper-most recording sheet 20 in the sheet feeding tray 21. The sheet feeding roller 26 conveys the fed recording sheet 20 to the vertical sheet conveying path 27. If a plurality of recording sheets 20 are fed by the pickup roller 25, the reversing roller 28 separates the recording sheets 20 underneath the upper-most recording sheet 20 and returns the separated recording sheets 20 to the sheet feeding tray 21. FIG. 4 is a drawing illustrating a main portion of a FRR (Feed Reverse Roller) type sheet feeding section. A guide plate 29 is provided at a downstream side of a nip region 26*a* in the recording sheet 20 conveying direction. The nip region 26*a* is formed between the sheet feeding roller 26 and reversing roller 28 such that the nip region 26*a* is positioned between a plurality of guide plates 29. A detailed description on a sheet separation mechanism and operation of the FRR type sheet feeding section is omitted as those are commonly known.

According to the example of the present invention, a reflective photosensor 40 that detects a type of a recording sheet is provided to a portion of the guide plate 29 which is located at a downstream side of the nip region 26*a* in the recording sheet 20 conveying direction. The reflective photosensor 40 emits light through a notch 29*a* that is formed in the guide plate 29 and detects the light reflected from the recording sheet 20 passing through the space formed between the guide plates 29. The type of the recording sheet 20 is detected based on an output of the reflected light. Namely, the reflective photosensor 40 detects a reflectivity of the fed recording sheet 20. The type of the recording sheet 20 is thus detected based on the detected reflectivity.

When the recording sheet 20 is fed, a supporting arm 25*a* (which supports the pickup roller 25) is rotated in a counterclockwise direction in FIG. 3 by a motor (not shown) which is rotated according to an instruction provided from a system control section 201. Thus, the pickup roller 25 contacts an upper-most sheet of a bunch of recording sheets 20. Because the pickup roller 25 is rotated in a counterclockwise direction, the recording sheet 20 is conveyed to the nip region 26*a* formed between the sheet feeding roller 26 and reversing roller 28. If a single recording sheet 20 is conveyed to the nip region 26*a*, the recording sheet 20 is then fed by the sheet feeding roller 26. If a plurality of recording sheets 20 are conveyed to the nip region 26*a*, the reversing roller 28 rotates in a direction reverse to the direction in which the recording sheet 20 is conveyed so as to separate the plurality of recording sheets 20. Thus, only a single recording sheet 20 is fed. As illustrated in FIG. 4, the reflective photosensor 40 is arranged at a position near the sheet feeding roller 26 and on a downstream side of the sheet feeding roller 26 in the recording sheet 20 conveying direction. However, it is to be understood that the reflective photosensor 40 may be provided at any position between the position illustrated in FIG. 4 and separation pick 81 in a sheet conveying path. If the separation pick 81 is not provided, the reflective photosensor 40 may be provided at any position between the position illustrated in FIG. 4 and registration roller 23 in the sheet conveying path. When the reflective photosensor 40 is arranged at the above-described position, the recording sheet 20 can be controlled such that the recording sheet 20 is not conveyed to the image forming section 1.

Figure 5:
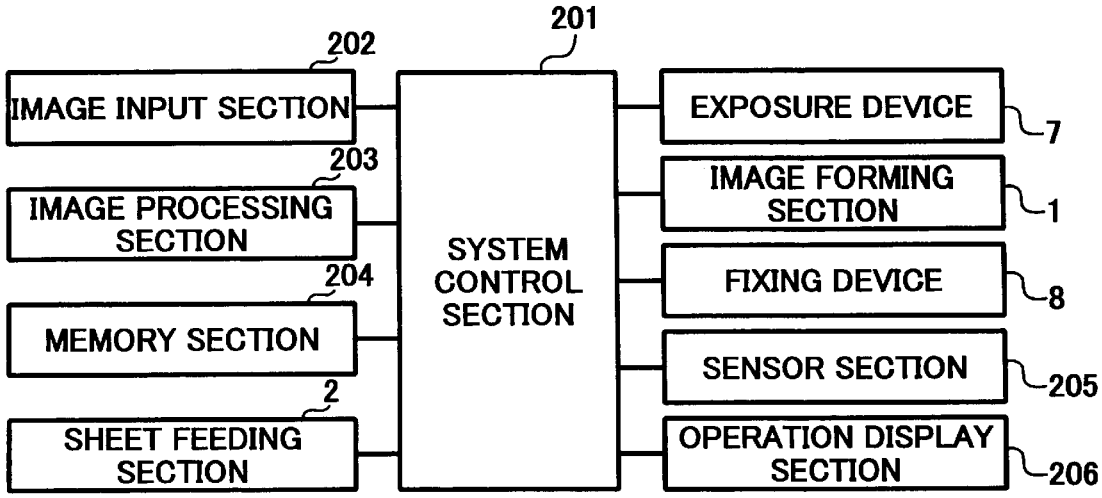
FIG. 5 is a block diagram illustrating a construction of a controlling system of the image forming apparatus.

FIG. 5 is a block diagram illustrating a construction of a controlling system of the image forming apparatus. The image forming apparatus according to the example of the present invention is an electrophotographic image forming apparatus. The image forming apparatus includes the system control section 201, an image input section 202, an image processing section 203, a memory section 204, the sheet feeding section 2, an exposing device 7, an image forming section 1, a fixing device 8, a sensor section 205, and an operation display section 206. The system control section 201 can include at least a CPU, ROM, and RAM. The CPU controls the above-described sections and an entire system of the image forming apparatus based on a program stored in the ROM while using the RAM as a work area. In addition, the RAM stores various data used by the CPU during a processing stage.

Image data for forming an image is input into the image input section 202 via a scanner (i.e., image reading section 3) and/or a network. The image data input from the scanner is processed by the image processing section 203. The image data is then stored in the memory section 240 and/or an image writing operation is directly performed by the exposing device 7. If data, in which an image is processed, is input, for example, from a facsimile, the data is stored in the memory section 204 without being processed by the image processing section 203 and/or the image writing operation is directly performed by the exposing device 7. In the image forming section 1, a latent image formed on a surface of the photoconductive element 61 through an image writing operation is developed into a visible toner image. The toner image is transferred onto the recording sheet 20 conveyed from the sheet feeding section 2. The toner image is fixed by the fixing device 8. The recording sheet 20 having the fixed toner image is then discharged. When an image is formed on both surfaces of the recording sheet 20, the recording sheet 20 is reversed by the duplex unit 9 and conveyed to the image forming section 1 again. After the image is formed on a back surface of the recording sheet 20, the recording sheet 20 is discharged.

The sensor section 205 includes various types of sensors, such as a sensor for detecting a recording sheet conveying state and a sensor for detecting a density of a toner image formed on a surface of the photoconductive element 61. Detected information is output to the system control section 201. The reflective photosensor 40 is included in the sensor section 205. The operation display section 206 is provided so that an operator inputs various data, such as a desired printing condition including a printing mode, the number of prints, a process of a recording sheet, and a type of the recording sheet. In the image forming apparatus according to the example of the present invention, the operation display section 206 is arranged on a top surface of a casing of the image forming apparatus. The operation display section 206 includes a touch panel input device having a liquid crystal display in addition to a key input device. Various information, such as an input set condition and warning indicating that an image forming operation is not performed according to the set condition, is displayed on the liquid crystal display.

A recording sheet type detection device includes, for example, the reflective photosensor 40. The recording sheet type detection device determines a type of a recording sheet based on a difference in a reflectivity. The reflectivity of a recording sheet is previously measured which is stored in the memory section 204 as a table. The stored data on the reflectivity of various recording sheets is detected based on an input of reflected light of the reflective photosensor 40. For example, a relationship between a type of a recording sheet and the reflectivity is described below.

| | |
|---|---|
| Coated sheet | 80% |
| Film | 70% |
| Normal sheet | 50% |
| Recycled sheet | 35% |

Based on the values of the reflectivity, a plurality of threshold values are set to the output of the reflective photosensor 40 to determine at least above-described four types of the recording sheets. In this case, the coated sheet and film correspond to a recording sheet for an ink jet printer and an overhead transparency film sheet, respectively. If the type of the recording sheet is not properly determined by a single reflective photosensor 40, a plurality of photosensors 40 with different sensitivities are provided to determine the type of the recording sheet based on a relationship between the above-described reflectivity and sensitivities of the plurality of the photosensors 40.

According to the example of the present invention, when an image forming operation is started, a recording sheet is fed from the sheet feeding tray 21. The reflective photosensor 40 detects a reflectivity of the recording sheet. Based on the detected reflectivity, a type of the recording sheet is determined. If the detected result indicates that the type of the recording sheet does not match the type of the recording sheet input through the operation display section 206 by an operator, the image forming operation is stopped. The apparatus gives a warning of a setting error of the operator, and discharges the recording sheet in a sheet conveying path (including the vertical sheet conveying path 27) to the sheet accommodating tray 82 without conveying the recording sheet through the image forming section 1 and fixing device 8. As illustrated in FIG. 2B, the separation pick 81, disposed at an upstream side of the registration roller 23 in the recording sheet 20 conveying direction in the vertical sheet conveying path 27, is switched such that the recording sheet 20 is conveyed to the sheet accommodating tray 82 through the sheet discharging path 83.

In addition, if the recording sheet type detection device detects that detected information on the type of the recording sheet does not match a condition set by an operator before a printing operation is started, the apparatus gives a warning of the setting error of the operator suggesting that the condition be reset.

Figure 6A:
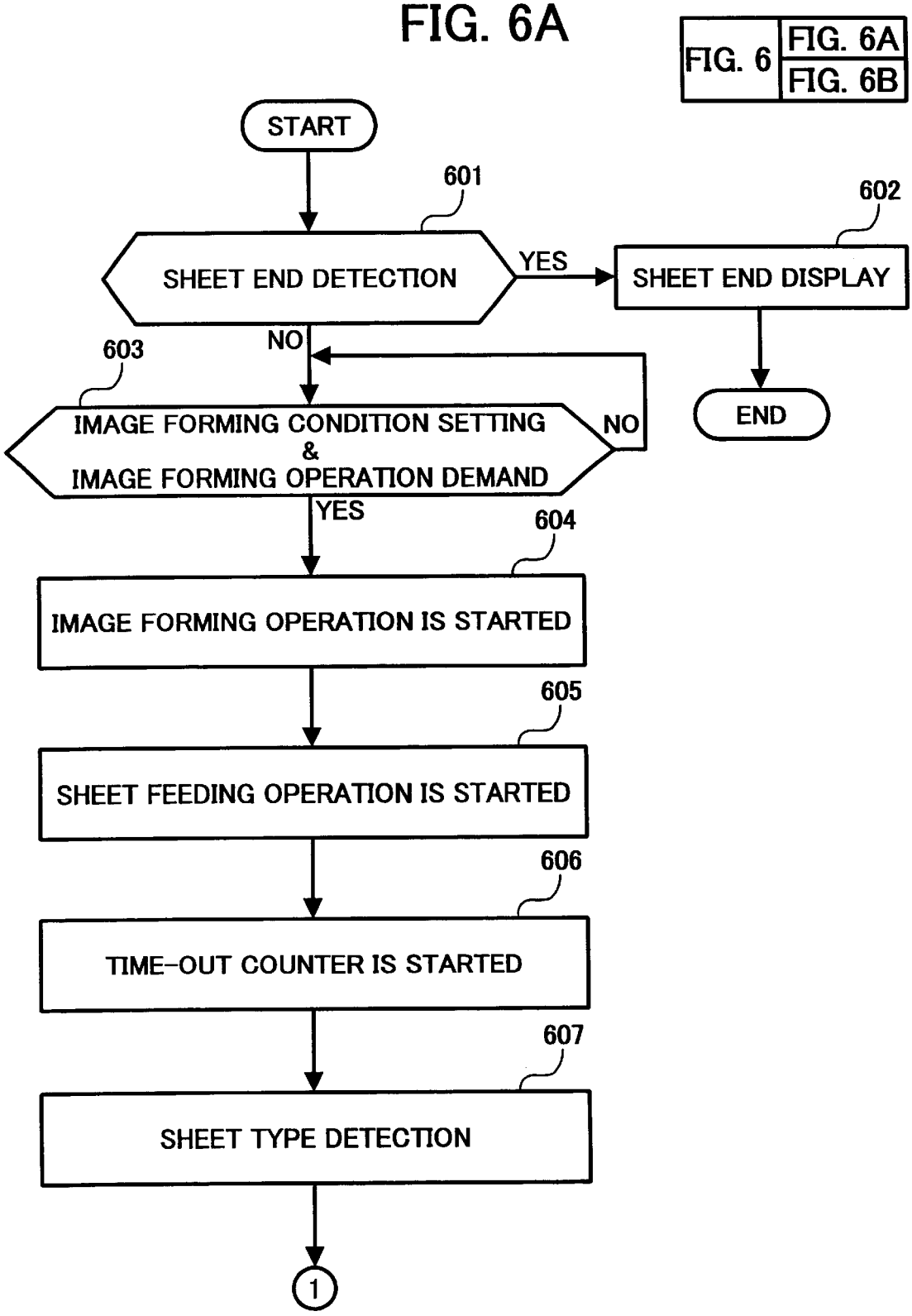
FIG. 6 is a flow chart illustrating an example of a controlling step of the image forming apparatus according to the example of the present invention when a reflective photosensor is provided in a sheet conveying path.
Figure 6B:
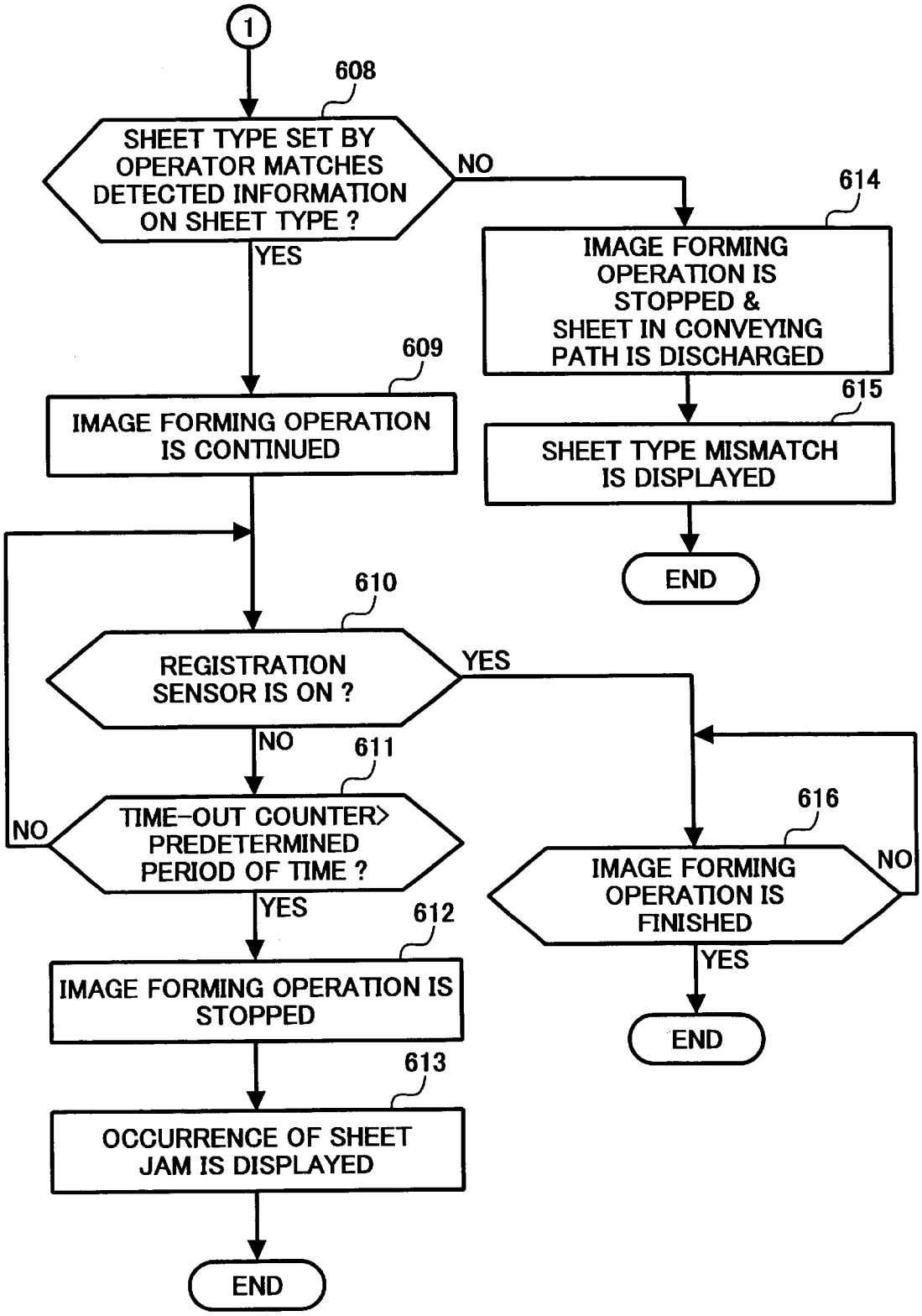
Figure 7A:
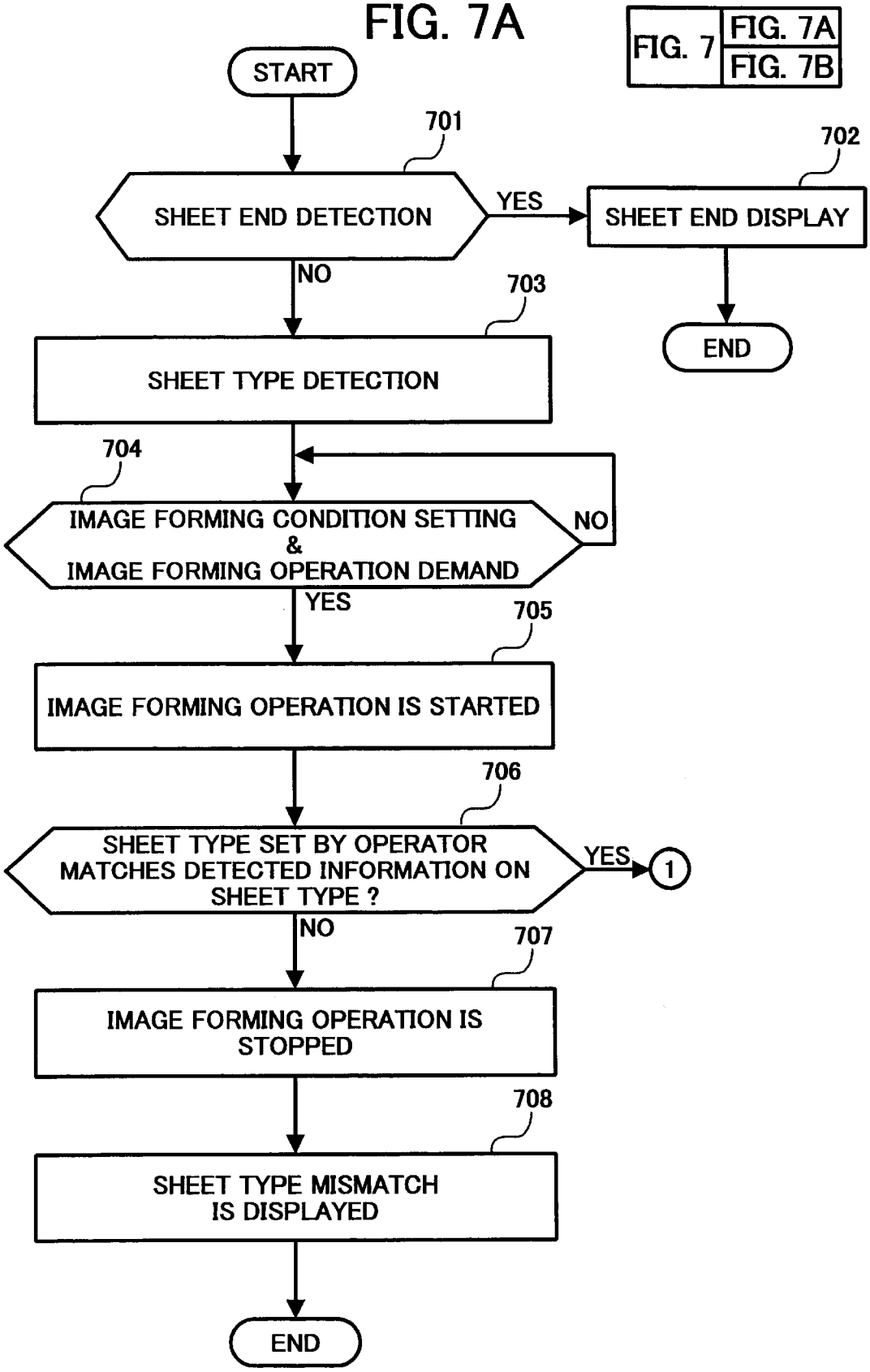
FIG. 7 is a flow chart illustrating an example of a controlling step of the image forming apparatus when the reflective photosensor is provided to a sheet feeding tray.
Figure 7B:
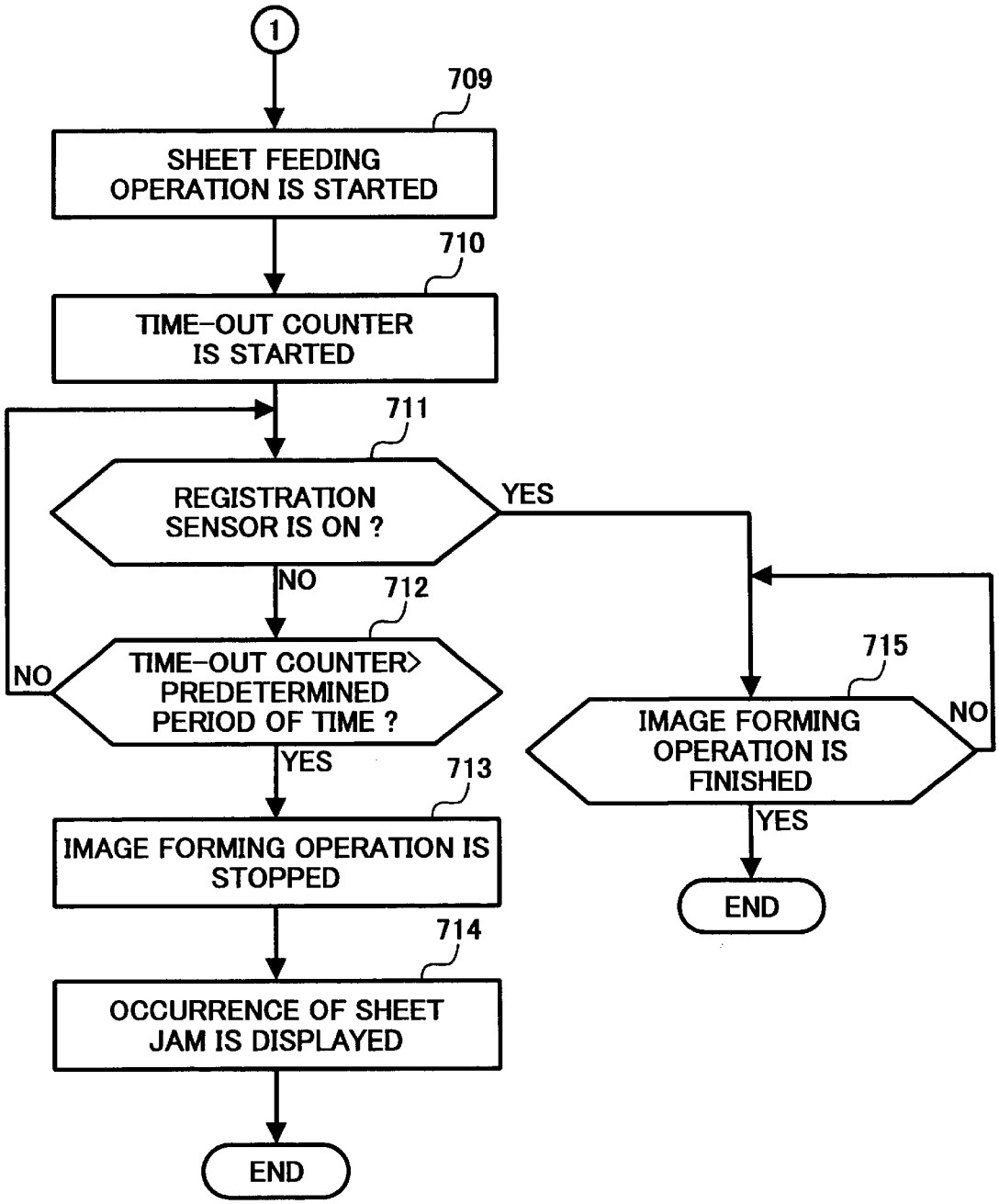

FIGS. 6 and 7 are flow charts illustrating processing steps in the above-described operation. The process is performed by the CPU in the system control section 201. The CPU performs the process based on a program stored in the ROM (not shown) while using the RAM (not shown) as a work area. Thus, the processes described in the flow charts are performed.

FIG. 6 is a flow chart illustrating an example of a controlling step of the image forming apparatus according to the example of the present invention, when the reflective photosensor 40 is provided in the sheet conveying path formed between the sheet feeding tray 21 and registration roller 23. A sheet end detecting sensor (not shown) provided in the sheet feeding tray 21 determines whether or not the recording sheet 20 exists in the sheet feeding tray 21 at step 601. If it is determined that there is no recording sheet 20 in the sheet feeding tray 21, the apparatus displays a warning of a sheet end at step 602. The process is then finished. Whether or not an image forming condition is set and an image forming instruction is input is determined at step 603. The setting of the image forming condition is made through the operation display section 206. The image forming instruction is provided by pressing a start button. When the inputting of the image forming condition is performed and an image forming instruction is provided, an image forming operation is started at step 604. A sheet feeding operation is started at step 605. The recording sheet 20 is then fed one by one from the sheet feeding tray 21 to the registration roller 23. Thus, a time-out counter starts the operation at step 606.

The reflective photosensor 40 (which is disposed at an immediate downstream side of the sheet feeding roller 26 in the recording sheet 20 conveying direction) detects light reflected from a surface of the recording sheet 20 fed from the sheet feeding tray 21, and outputs a result of the detection. A reflectivity of the recording sheet 20 is calculated based on the output of the detection. When the reflectivity is calculated, it is determined that the recording sheet 20 is one of the above-described four types at step 607 based on the data on the reflectivity of each type of recording sheets stored in the memory section 204. When the type of the fed recording sheet 20 is determined, whether or not the type of the recording sheet 20 set by the operator at step 603 matches the type of the recording sheet 20 determined at step 607 is determined at step 608. If the type of the fed recording sheet 20 matches the type of the recording sheet 20 set by the operator, the image forming operation is continued at step 609. Then, whether or not the recording sheet 20 is conveyed to the registration roller 23 is determined at step 610 based on an on and off operation of a registration sensor (not shown) that is disposed at a position at an upstream side of the registration roller 23 in the recording sheet conveying direction immediately before the registration roller 23.

If it is determined that the recording sheet 20 is conveyed to the registration roller 23, the registration roller 23 conveys the recording sheet 20 to the transfer device 51 adjusting the feed timing such that the recording sheet 20 is in precise register with a toner image on the intermediate transfer belt 5. The image forming operation is continued until a desired image forming operation is completed at step 616. If the registration sensor is not turned on, whether or not the time counted by the time-out counter exceeds a predetermined period of time is determined at step 611. If the counted time exceeds the predetermined period of time, it is determined that the recording sheet 20 is jammed. Then, the image forming operation is stopped at step 612. The apparatus thus displays an occurrence of a sheet jam at step 613.

With the above-described control, problems that arise when a type of a recording sheet set by an operator does not match the type of the recording sheet fed from the sheet feeding tray 21, such as a winding of the recording sheet around a fixing roller or a low level of fixing performance on an overhead transparency film sheet, are prevented.

Figure 8:
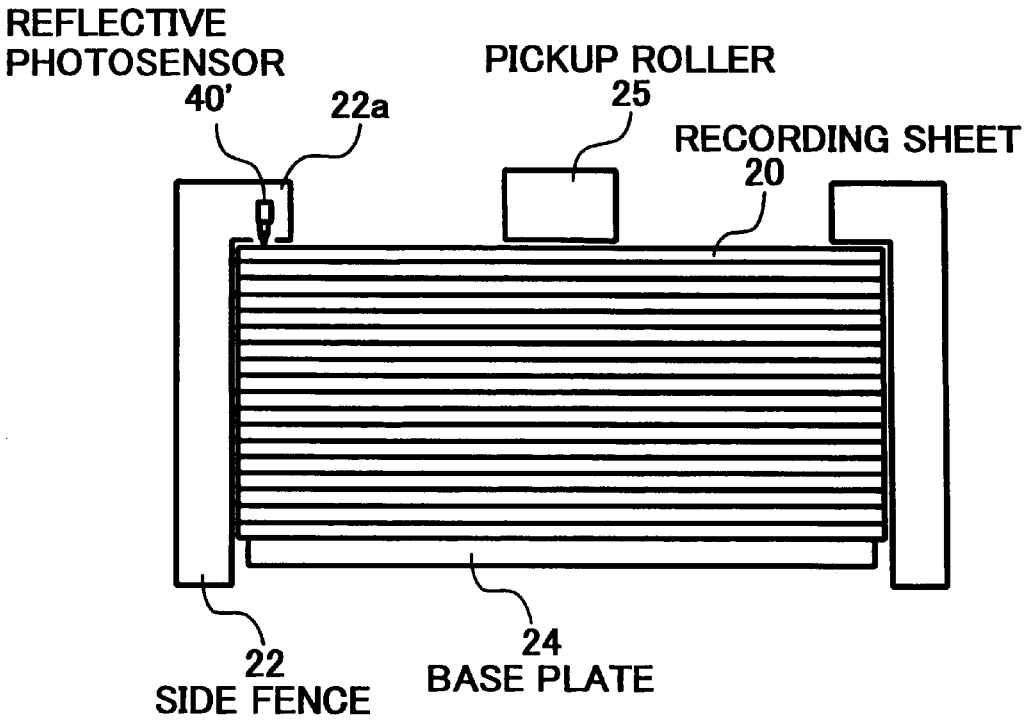
FIG. 8 is a drawing illustrating the sheet feeding tray having the reflective photosensor.

FIG. 7 is a flow chart illustrating an example of a controlling step of the image forming apparatus when the image forming apparatus is configured such that a type of the recording sheet 20 is detected before the recording sheet 20 is fed from the sheet feeding tray 21. According to this example, a reflective photosensor 40' is provided at a specific portion of the sheet feeding tray 21 instead of being positioned at a downstream side of the sheet feeding tray 21 in a recording sheet conveying direction in the sheet conveying path. According to this example, the reflective photosensor 40' is provided at a hook-shaped portion 23*a* formed at an upper end portion of the side fence 22. The reflective photosensor 40' is disposed in a downward direction such that it faces the recording sheet 20. The side fence 22 is provided to even up edges of a stack of the recording sheets 20 in a direction perpendicular to a direction in which the recording sheet 20 is conveyed. The above-described configuration is also applied to the manual sheet feeding tray 84. In this case, the reflective photosensor 40' is provided on a side fence 84*a* of the manual sheet feeding tray 84 in a similar manner illustrated in FIG. 8.

When the reflective photosensor 40' is provided to the sheet feeding tray 21 or manual sheet feeding tray 84, a type of the recording sheet 20 set in the sheet feeding tray 21 or manual sheet feeding tray 84 is detected before an image forming operation is started. Thus, if the detected type of the recording sheet 20 does not match the type of the recording sheet 20 set by an operator, the image forming operation is stopped without feeding the recording sheet 20, thereby eliminating the necessity of having a forcible recording sheet discharging section including the separation pick 81, sheet discharging path 83, and sheet accommodating tray 82.

The reflective photosensor 40' provided in the side fence 22 of the sheet feeding tray 21 determines whether or not the recording sheet 20 exists in the sheet feeding tray 21 at step 701. According to this example, the reflective photosensor 40' functions as a sheet end detecting sensor. If it is determined that there is no recording sheet 20 in the sheet feeding tray 21, the apparatus displays a warning of a sheet end on the operation display section 206 at step 702. The process is then finished. When it is determined that the recording sheet 20 is loaded in the sheet feeding tray 21, detection of a type of the recording sheet 20 is performed at step 703. An output of the detection performed by the reflective photosensor 40' at step 701 has been transmitted to the system control section 201. Thus, the system control section 201 performs the detection of the sheet end and the type of the recording sheet 20 based on the output from the reflective photosensor 40'. Then, whether or not an image forming condition is set and an image forming instruction is input is determined at step 704. The setting of the image forming condition is made through the operation display section 206. The image forming instruction is provided by pressing the start button. When the inputting of the image forming condition is performed and an image forming instruction is provided, an image forming operation is started at step 705. Whether or not the type of the recording sheet 20 set by the operator at step 704 matches the type of the recording sheet 20 determined at step 703 is determined at step 706. If the type of the fed recording sheet 20 does not match the type of the recording sheet 20 set by the operator, the image forming operation is stopped at step 707. The apparatus displays a warning of a mismatch at step 708. The process is then finished without feeding the recording sheet 20. A type of the recording sheet 20 is determined in a manner similar to that described in reference to FIG. 6.

If it is determined at step 706 that the type of the fed recording sheet 20 matches the type of the recording sheet 20 set by the operator, the recording sheet 20 is fed from the sheet feeding tray 21 at step 709. The time-out counter starts counting at step 710. Whether or not the recording sheet 20 is conveyed to the registration roller 23 is determined at step 711 based on an on and off operation of the registration sensor (not shown) that is disposed at a position at an upstream side of the registration 23 in the recording sheet conveying direction immediately before the registration roller 23. If it is determined that the recording sheet 20 is conveyed to the registration roller 23, the registration roller 23 conveys the recording sheet 20 to the transfer device 51 adjusting the feeding timing such that the recording sheet 20 is in precise register with a toner image on the intermediate transfer belt 5. Thus, the image is formed on the recording sheet 20. The image forming operation is continued until a desired image forming operation is completed at step 715.

If the registration sensor is not turned on, whether or not the time counted by the time-out counter exceeds a predetermined period of time is determined at step 712. If the counted time exceeds the predetermined period of time, it is determined that the recording sheet 20 is jammed. Then, the image forming operation is stopped at step 713. The apparatus thus displays an occurrence of a sheet jam at step 714.

According to the example described referring to FIG. 7, a sheet conveying path through which the recording sheet 20 is forcibly discharged is not required. The reflective photosensor 40' that detects a reflectivity of the recording sheet 20 is provided on the sheet feeding tray 21, thereby eliminating the necessity of modifying a hardware construction of an image forming apparatus.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2001-136368, filed on May 7, 2001, and Japanese Patent Application No. 2002-113429, filed on Apr. 16, 2002, and the entire contents thereof are herein incorporated by reference.

What is claimed as new and is desired to be secured by Letters Patent of the United States is:

1. An image forming apparatus, comprising:

a recording sheet type detection device configured to automatically detect a type of a recording sheet, the recording sheet type detection device disposed below a notch in a guide plate adapted to guide the recording sheet to a nip region;

a setting device configured to set an image forming condition by an operator, the image forming condition including the type of the recording sheet;

an image forming device configured to form a visible image on the recording sheet;

a sheet feeding device configured to feed the recording sheet to the image forming device; and a controller configured to control the image forming apparatus not to form an image on the recording sheet when the image forming condition with regard to the type of the recording sheet set by the operator does not match the type of the recording sheet detected by the recording sheet type detection device.

2. The image forming apparatus according to claim 1, wherein the recording sheet type detection device includes a photosensor.

3. The image forming apparatus according to claim 1, wherein the recording sheet type detection device is provided in a sheet conveying path formed between a recording sheet loading section where the recording sheet is loaded and a registration section where a time for feeding the recording sheet to the image forming device is adjusted.

4. The image forming apparatus according to claim 1, further comprising a display device, wherein the controller controls the image forming apparatus to display a message, indicating that the type of the recording sheet set on the display device does not match the type of the recording sheet detected by the recording sheet type detection device and that the image forming operation is not performed, on the display device.

5. An image forming apparatus, comprising:

a recording sheet type detection device configured to automatically detect a type of a recording sheet;

a setting device configured to set an image forming condition by an operator, the image forming condition including the type of the recording sheet;

an image forming device configured to form a visible image on the recording sheet;

a sheet feeding device configured to feed the recording sheet to the image forming device; and a controller configured to control the image forming apparatus not to form an image on the recording sheet when the image forming condition with regard to the type of the recording sheet set by the operator does not match the type of the recording sheet detected by the recording sheet type detection device, wherein the recording sheet type detection device is provided at a position where the type of the recording sheet is determined before a recording sheet operation is started.

6. The image forming apparatus according to claim 5, wherein the recording sheet type detection device is provided to a recording sheet position regulating member in the recording sheet loading section.

7. An image forming apparatus, comprising:

a recording sheet type detection device configured to automatically detect a type of a recording sheet;

a setting device configured to set an image forming condition by an operator, the image forming condition including the type of the recording sheet;

an image forming device configured to form a visible image on the recording sheet;

a sheet feeding device configured to feed the recording sheet to the image forming device;

a controller configured to control the image forming apparatus not to form an image on the recording sheet when the image forming condition with regard to the type of the recording sheet set by the operator does not match the type of the recording sheet detected by the recording sheet type detection device; and a sheet discharging path configured to discharge the recording sheet from the sheet conveying path formed between the recording sheet loading section and the registration section.

8. The image forming apparatus according to claim 7, further comprising a separation pick configured to switch a sheet conveying path from the sheet conveying path to the sheet discharging path.

9. The image forming apparatus according to claim 8, wherein the recording sheet is discharged through the sheet discharging path.

10. An image forming apparatus, comprising:

a recording sheet type detection device configured to automatically detect a type of a recording sheet;

a setting device configured to set an image forming condition by an operator, the image forming condition including the type of the recording sheet;

an image forming device configured to form a visible image on the recording sheet;

a sheet feeding device configured to feed the recording sheet to the image forming device; and a controller configured to control the image forming apparatus not to form an image on the recording sheet when the image forming condition with regard to the type of the recording sheet set by the operator does not match the type of the recording sheet detected by the recording sheet type detection device, wherein the controller controls the image forming apparatus such that the recording sheet in the sheet conveying path is discharged without being conveyed to the image forming device, when the image is not formed on the recording sheet.

11. The image forming apparatus according to claim 10, further comprising a display device, wherein the controller controls the image forming apparatus to stop the image forming operation and display a message on the display device.

12. The image forming apparatus according to claim 10, further comprising a display device, wherein the controller controls the image forming apparatus to discharge the recording sheet and display a message on the display device.

13. The image forming apparatus according to claim 12, wherein the message displayed on the display device includes a message indicating that the type of the recording sheet set by the operator is different from the type of the recording sheet detected by the recording sheet type detection device.

14. The image forming apparatus according to claim 12, wherein the message displayed on the display device includes a message indicating that the recording sheet is discharged without forming an image on the recording sheet.

15. An image forming apparatus, comprising:

a recording sheet type detection device configured to automatically detect a type of a recording sheet;

a setting device configured to set an image forming condition by an operator, the image forming condition including the type of the recording sheet;

an image forming device configured to form a visible image on the recording sheet;

a sheet feeding device configured to feed the recording sheet to the image forming device; and a controller configured to control the image forming apparatus to stop an image forming operation after the image forming operation is started according to an instruction provided by the operator, when the image forming condition with regard to the type of the recording sheet set by the operator does not match the type of the recording sheet detected by the recording sheet type detection device.

16. The image forming apparatus according to claim 15, wherein the recording sheet type detection device includes a photosensor.

17. The image forming apparatus according to claim 15, wherein the recording sheet type detection device is provided in a sheet conveying path formed between a recording sheet loading section where the recording sheet is loaded and a registration section where a time for feeding the recording sheet to the image forming device is adjusted.

18. The image forming apparatus according to claim 15, wherein the recording sheet type detection device is provided at a position where the type of the recording sheet is determined before a recording sheet feeding operation is started.

19. The image forming apparatus according to claim 18, wherein the recording sheet type detection device is provided to a recording sheet position regulating member in the recording sheet loading section.

20. The image forming apparatus according to claim 15, further comprising a sheet discharging path configured to discharge the recording sheet from the sheet conveying path formed between the recording sheet loading section and the registration section.

21. The image forming apparatus according to claim 20, further comprising a separation pick configured to switch a sheet conveying path from the sheet conveying path to the sheet discharging path.

22. The image forming apparatus according to claim 21, wherein the recording sheet is discharged through the sheet discharging path.

23. The image forming apparatus according to claim 15, wherein the controller controls the image forming apparatus to stop the image forming operation and discharges the recording sheet in the sheet conveying path without conveying the recording sheet to the image forming device.

24. The image forming apparatus according to claim 23, further comprising a display device, wherein the controller controls the image forming apparatus to discharge the recording sheet and display a message on the display device.

25. The image forming apparatus according to claim 15, further comprising a display device, wherein the controller controls the image forming apparatus to stop the image forming operation and display a message on the display device.

26. The image forming apparatus according to claim 25, wherein the message displayed on the display device includes a message indicating that the type of the recording sheet set by the operator is different from the type of the recording sheet detected by the recording sheet type detection device.

27. The image forming apparatus according to claim 25, wherein the message displayed on the display device includes a message indicating that the recording sheet is discharged without forming an image on the recording sheet.

28. A method of forming an image, comprising:

providing a recording sheet type detection device to detect a type of recording sheet below a notch in a guide plate adapted to guide the recording sheet to a nip region;

providing a setting device through which an operator set an image forming condition, the image forming condition including the type of the recording sheet; and controlling an image forming apparatus not to form an image on the recording sheet when the image forming condition with regard to the type of the recording sheet set by the operator does not match the type of the recording sheet detected by the recording sheet type detection device.

29. A method of forming an image, comprising:

providing a recording sheet type detection device;

providing a setting device through which an operator set an image forming condition, the image forming condition including a type of a recording sheet; and controlling an image forming apparatus to stop an image forming operation after the image forming operation is started according to an instruction provided by the operator when the image forming condition with regard to the type of the recording sheet set by the operator does not match the type of the recording sheet detected by the recording sheet type detection device.

30. An image forming apparatus, comprising:

means for automatically detecting a type of a recording sheet, the means for automatically detecting disposed below a notch in a guide plate adapted to guide the recording sheet to a nip region;

means for setting an image forming condition by an operator, the image forming condition including the type of the recording sheet;

means for forming a visible image on the recording sheet;

means for feeding the recording sheet to the means for forming the visible image; and means for controlling the image forming apparatus not to form an image on the recording sheet when the image forming condition with regard to the type of the recording sheet set by the operator does not match the type of the recording sheet detected by the recording sheet type detection device.

31. An image forming apparatus, comprising:

means for automatically detecting a type of a recording sheet;

means for setting an image forming condition by an operator, the image forming condition including the type of the recording sheet;

means for forming a visible image on the recording sheet;

means for feeding the recording sheet to the means for forming the visible image; and means for controlling the image forming apparatus to stop an image forming operation after the image forming operation is started according to an instruction provided by the operator, when the image forming condition with regard to the type of the recording sheet set by the operator does not match the type of the recording sheet detected by the recording sheet type detection device.

* * * * *